US005461838A

United States Patent [19]

Heller

[11] Patent Number: 5,461,838

[45] Date of Patent: Oct. 31, 1995

[54] FIRE BARRIER

[76] Inventor: Paul S. Heller, 14041 Mar Vista St., Whittier, Calif. 90602

[21] Appl. No.: 296,423

[22] Filed: Aug. 25, 1994

[51] Int. Cl.[6] ..... E04B 1/62

[52] U.S. Cl. ..... 52/396.01; 52/573.1; 52/232; 52/317; 52/167.1

[58] Field of Search ..... 52/396.01–396.09, 52/393, 232, 317, 461, 573.1, 167.1

[56] References Cited

U.S. PATENT DOCUMENTS

| | | | |
|---|---|---|---|
| 3,659,390 | 5/1972 | Balzer et al. . | |
| 4,290,249 | 9/1981 | Mass . | |
| 4,517,779 | 5/1985 | Dunsworth . | |
| 4,566,242 | 1/1986 | Dunsworth . | |
| 4,651,488 | 3/1987 | Nicholas et al. . | |
| 4,706,426 | 11/1987 | Rumsey . | |
| 4,811,529 | 3/1989 | Harris et al. . | |
| 4,882,890 | 11/1989 | Rizza . | |
| 4,942,710 | 7/1990 | Rumsey . | |
| 4,967,527 | 11/1990 | Gohlke . | |
| 4,977,719 | 12/1990 | LaRoche et al. | 52/396.01 |
| 4,999,962 | 3/1991 | Gohlke et al. . | |
| 5,048,249 | 9/1991 | Shreiner et al. | 52/396.07 |
| 5,074,089 | 12/1991 | Kemmer et al. | 52/461 X |
| 5,140,797 | 8/1992 | Gohlke et al. . | |
| 5,365,713 | 11/1994 | Nicholas et al. | 52/573.1 |

*Primary Examiner*—William P. Neuder
*Assistant Examiner*—Robert J. Canfield
*Attorney, Agent, or Firm*—Gunther Hanke

[57] ABSTRACT

A fire barrier for use in dynamic voids to seal against the spread of fire. Flexible barrier material is suspended below a lazy tong arrangement spanning the void while the edges of the barrier material are biased against the walls of the joint to provide the necessary seal.

16 Claims, 2 Drawing Sheets

FIRE BARRIER

BACKGROUND OF THE INVENTION

1. Field of the Invention

The present invention generally relates to fire barriers for use in voids formed in buildings, and more particularly, pertains to systems that continue to maintain an effective barrier against the spread of fire despite a substantial relative displacement or distortion of the surfaces that define such voids.

2. Description of Related Art

A variety of dynamic voids or joints are typically incorporated in a building in order to prevent damage as the structure undergoes movement due to thermal, wind and seismic loads. In order to prevent the spread of heat, smoke, and flames therethrough, such voids must be fitted with fire barriers. It is especially important for a fire barrier fitted to a joint to remain in tact after the joint has undergone substantial displacement or distortion due to seismic activity, as the risk of fire is especially high immediately following an earthquake.

Various barrier systems have been devised that attempt to accommodate the magnitude of movement anticipated during a seismic event. A substantial widening and/or narrowing of a seismic joint can be expected, while lateral or shear displacement on the order of several feet is not unusual. Fire barriers typically consist of a sheet of flexible material that is attached to each wall of the joint and loosely draped therebetween. Such configuration does not in any way impede the narrowing of the gap while the slack in the material accommodates a widening of the gap beyond its nominal width. Any differential vertical displacement between the two sides of the joint, is similarly compensated for by the flexible material. In order to prevent failure of such a barrier when the joint undergoes substantial lateral displacement, various mechanisms have additionally been provided in order to allow one or both sides of the barrier to shift along the walls of the joint. Some configurations provide for the barrier to be rigidly affixed to one side of the joint while the opposite edge of the barrier is slideably retained in a groove or track attached to the opposite wall of the joint. Alternatively, both edges of the barrier are retained within grooves or tracks formed in both sides of the joint in order to allow both sides to shift laterally relative the walls of the joint.

These prior art fire barriers suffer from a number of shortcomings. First and foremost, as the joint walls shift laterally in the described systems, substantial shear loads are transferred to the barrier material due to the friction inherent in the groove or track attachment configurations. Any distortion, damage or obstruction of the retaining tracks further aggravates the potential for failure. Furthermore, such systems are relatively complex and their retrofitment to typical in-place joint configurations may be problematic and therefore very costly.

SUMMARY OF THE INVENTION

The present invention provides a fire barrier that prevents the spread of smoke, heat and flame through a dynamic void such as a seismic joint. The system's configuration ensures that an effective barrier is maintained despite substantial displacement or distortion of the joint. Moreover, the barrier is relatively inexpensive, easily installed, and is readily retrofitted to many existing joint cover systems.

The barrier system of the present invention functions in conjunction with a diagonal bar mechanism, also known as an easy tong arrangement, that is commonly employed to maintain joint covers in position over a dynamic joint. Tracks incorporated in the opposite walls or top edges of the joint retain the ends of diagonally positioned bars that are distributed along the length of the joint. Wheels or rollers may be attached to the ends of the bars to reduce friction. As the joint narrows or widens, the angle of the bars adjust to compensate for the change in the joint's width. Relative lateral displacement causes the ends of the bars to simply slide or roll in their respective tracks. The fitment of hemispherical rollers or the incorporation of sufficient play in the mechanism by which the bars are retained in the tracks or grooves, allow the bars to angle upwardly and downwardly as the opposite sides of the joint undergo relative vertical displacement without in any way impeding the system's other degrees of freedom of movement.

The actual fire barrier component of the present invention consists of a flexible sheet or blanket material which many include layers of insulation sandwiched between metal foil backing. The barrier extends along the entire length of the joint and is of a width substantially greater than the nominal width of the joint. In one embodiment, the two long edges of the material are suspended directly from the above-described bar mechanism so as to allow the excess material therebetween to hang down into the joint. This is achieved by the use of hanger clips or hanger rails that are pivotally attached to the diagonal bars and that hook into complementing hooked features incorporated in or affixed to the edges of the barrier material. The edges of the material are biased into sliding engagement with the joint walls, either by the hanger clips or rails themselves or by additionally fitted spring members. Alternatively, the fire barrier component may be suspended from a cover plate that is maintained in a centered position by the above-described bar mechanism. Hanger clips extending downwardly from the cover support the fire barrier material, as well as bias its edges into sliding engagement with the joint walls. Spring members may additionally be fitted to ensure proper contact. Friction reducing surfaces may be applied either to the joint walls or incorporated in the barrier material, or both, in order to ensure the system's smooth operation.

The configuration of the present invention completely isolates the barrier material from shear forces during relative lateral movement of the walls of the joint while only very minor shear stresses are transferred to the material during a widening or narrowing of the joint as the diagonal support bars twist. The system is quickly and easily retrofitted to many joint cover-centering mechanisms already in place in many existing structures.

These and other features and advantages of the present invention will become apparent from the following detailed description of preferred embodiments which, taken in conjunction with the accompanying drawings, illustrate by way of example the principles of the invention.

DETAILED DESCRIPTION OF PREFERRED EMBODIMENT

The figures generally illustrate the fire barrier system of the present invention. The barrier material is disposed within a seismic joint by suspension from a series of diagonal bars that span the joint. The edges of barrier are urged against the walls of the joint so as to effect a seal against heat, smoke and flames yet remain easily shiftable along the length of the walls.

Figure 1:
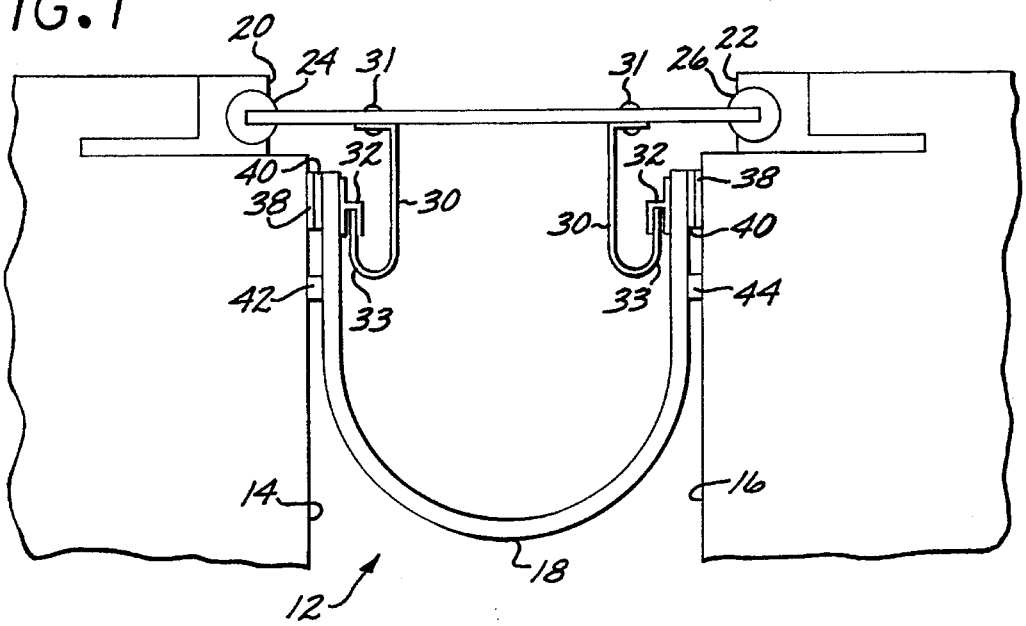
FIG. 1 is a cross-sectional view of the fire barrier system of the present invention.

FIG. 1 is a cross-section of the preferred embodiment of the present invention. A structural void 12, such as a seismic joint, is defined by opposing walls 14 and 16. Suspended therebetween is shown fire barrier 18 which comprises a sandwiched structure of layers of insulation between metal backing material.

A track or retention groove 20, 22 is securely incorporated in both sides of joint 12 and extends along substantially its entire length. A series of diagonally positioned support bars 28, having a length substantially greater than the nominal width of the joint, span the joint. Each bar is supported at its ends by wheels or hemispherical rollers rotatingly attached thereto and retained within the tracks. A widening of the joint causes each bar to assume a more perpendicular orientation as its ends shift within the retention tracks while a narrowing of the joint causes each bar to assume a more angled orientation. Such mechanism is sometimes referred to as a lazy-tong arrangement and is commonly employed to maintain a cover in a centered position above a dynamic joint.

Figure 2:
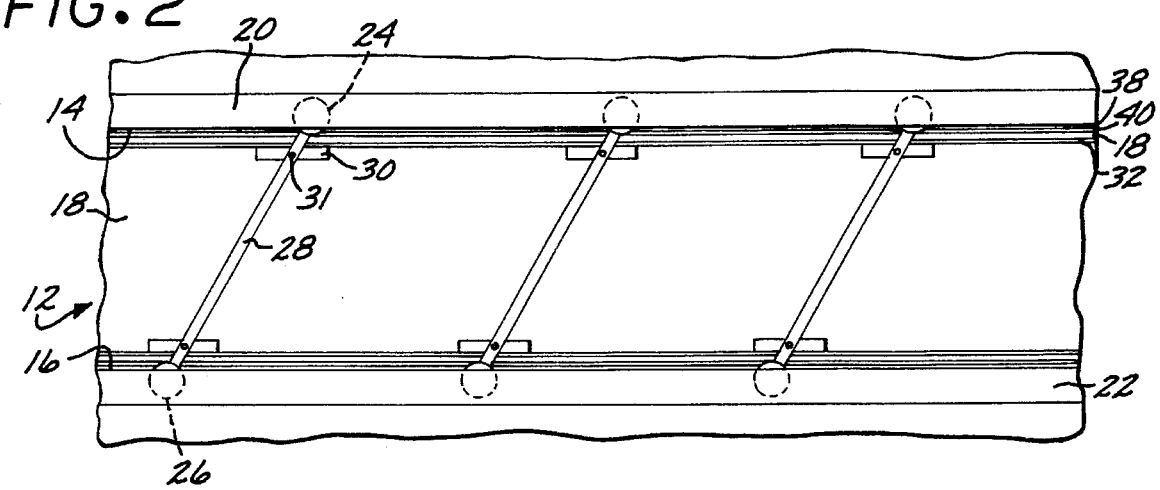
FIG. 2 is a top plan view of the system shown in FIG. 1.

In the system shown in FIGS. 1 and 2, the fire barrier material 18 is suspended from the diagonal support bars 28 by a series of hanger clips 30, each pivotally attached to a support bar at 31. Each clip terminates in an up-turned hook 33 that engages a downturned hook member 32 securely affixed to the barrier material 18 to provide support therefore. An alternative clip configuration may be employed that is pivotally affixed to the center of each support bar and supports, and biases both edges of the barrier material. Each clip is formed from spring material and is configured so as to exert a force against the walls 14, 16 of the joint 12. The clips thereby serve, to simultaneously support the fire barrier as well as bias it into sealing engagement with the joint walls.

Figure 3:
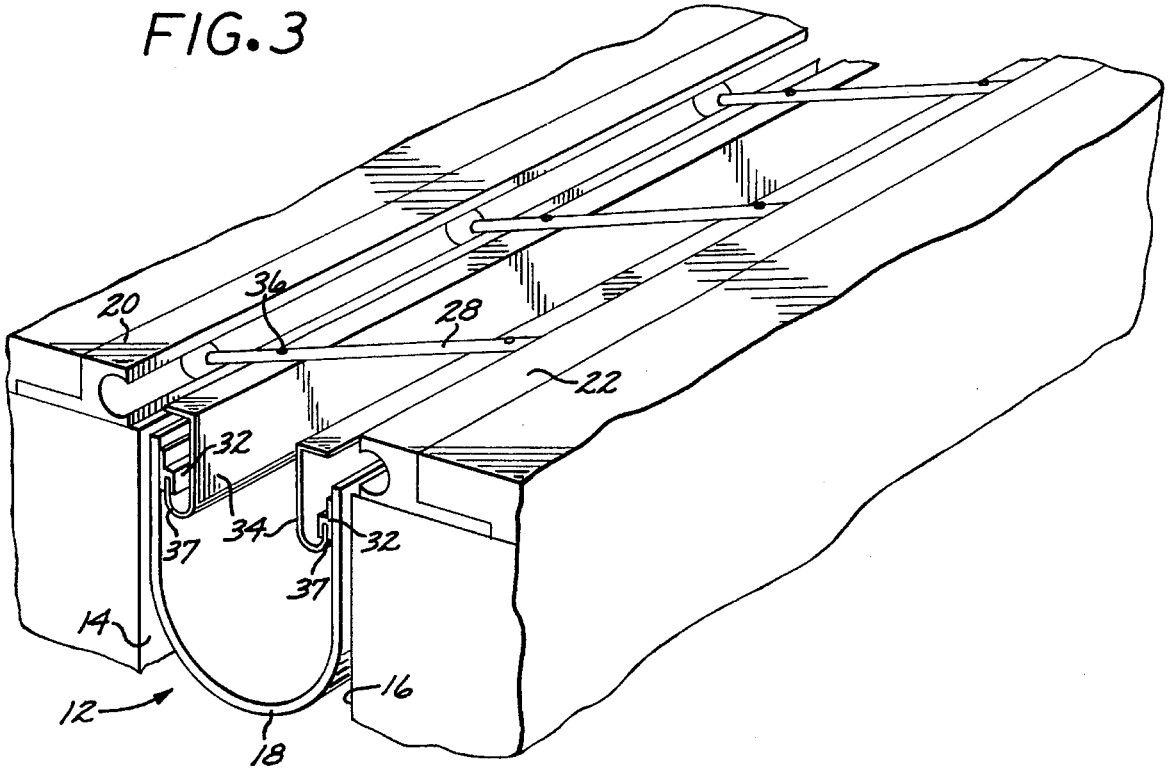
FIG. 3 is a perspective view of an alternative embodiment of the invention.

FIG. 3 illustrates an alterative embodiment in which a number individual spring clips are replaced by a single hanger rail 34 which extends along a substantial portion of the joint and is pivotally attached to a number of the support bars at 36. The hanger rail terminates in an upturned edge 37 that engages the downturned hook members 32 incorporated in the barrier material 18. The rail exerts a biasing force directed outwardly toward the walls of the joint.

Friction reducing surfaces 38, 40 may optionally be incorporated in the fire barrier/joint wall interface either by attachment to the wall, to the fire barrier material or to both. Additionally, intumescent material 42 may be disposed near the interface in order to ensure a proper seal upon being subjected to heat. Alternatively or in addition thereto, a foam strip 44 may be included in the interface to seal against cold smoke.

Figure 4A:
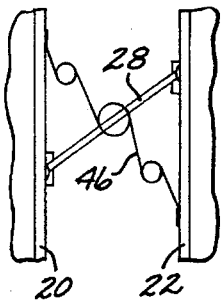
FIGS. 4*a*, b and c are top plan views of further alternative embodiments of the present invention.
Figure 4B:
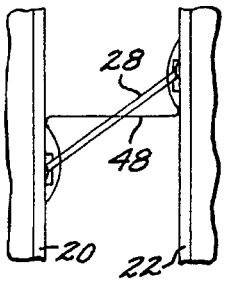
Figure 4C:
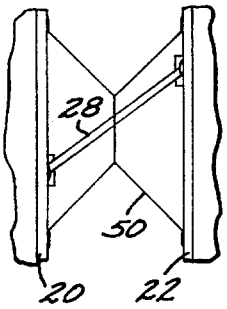

FIGS. 4*a*, b and c show alternative embodiments wherein additional springs 46, 48, 50 are used that either supplement the biasing function of the hanger clips or hanger rail against the joint's walls or exclusively provide such biasing force. Various configurations are shown which attach to the individual diagonal bars 28 at their centers and extend outwardly to engage the barrier material and urge it into contact with the joint walls.

Figure 5:
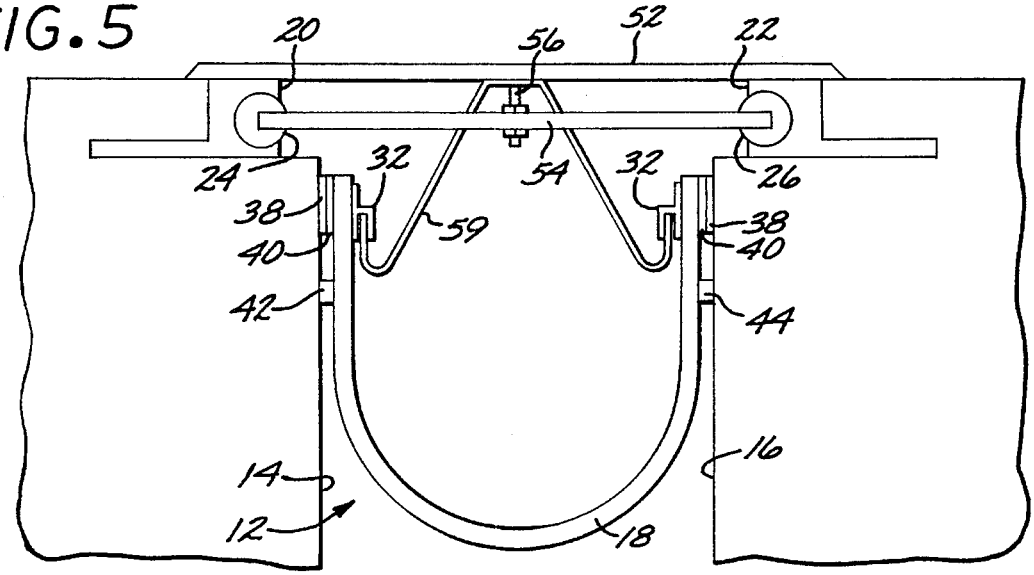
FIG. 5 is a cross-sectional view of another alternative embodiment of the invention.

FIG. 5 illustrates another embodiment of the present invention wherein barrier material 18 is suspended from cover plate 52 which in turn is maintained in a centered position over joint 12 by a diagonal bar mechanism 54. The cover plate is pivotally attached to the center of each support bar 56, while the barrier material is supported by hanger clips 58 that are attached to the cover plate. The hanger clips 58 both support the barrier material, as well as bias its edges against the joint walls 14 and 16. Alternatively, a separate hanger clip may be employed to support each edge of the material. Additionally, spring members may be fitted to complement the biasing function of the hanger clips, or may be solely relied upon to ensure proper contact between the barrier edges and the side walls.

In operation, the system of the present invention provides the function of preventing the spread of fire through the void to which it is fitted. Hangar clips 58 suspend the barrier 18 across the void 12 and urge its edges into firm contact with the walls 14, 16 of the void, thereby precluding the passage of smoke, heat and flame therethrough. The optionally incorporated intumescent material 42 melts upon exposure to heat to positively seal the interface. An optionally fitted foam strip 44 prevents the passage of cold smoke therethrough.

Relative movement of the walls of the joint does not in any way compromise the system's ability to fulfill its fire barrier function. Relative movement of the joint walls 14, 16 in a direction normal to the length of the joint 12, i.e. a widening or narrowing thereof, causes the diagonal bars 28 to twist while the ends 24, 26 of the bars shift slightly in opposite directions within their respective retention grooves 20, 22. This causes only a very slight amount of shear stress to be transferred to the barrier material which it is easily capable of accommodating. The edges of the material continue to be urged into firm contact with the walls at all times.

A relative vertical displacement of the sides of the joint causes the bars 28 to be angled out of the horizontal without in anyway diminishing the contact of the barrier material 18 with the walls 14, 16. Play inherent in the bar end retention system or the use hemispherical rollers 24, 26 allow the diagonal support bars to easily compensate for such movement without compromising their ability to move in the other directions.

In the event the joint 12 is subjected to relative lateral movement, the ends of the diagonal bars 24, 26 simply roll or shift in their respective retention grooves 20, 22. The angle of the bars does not change and consequently, absolutely no shear loads are transferred to the barrier material 18 itself. Friction-reducing material 38, 40 incorporated in the joint wall/fire barrier interface ensures that the barrier does not snag during wall displacement thereby ensuring the system's smooth operation. Regardless of the final configuration resulting from the relative displacements or contortions of the joint walls, the barrier 18 will remain in tact and will continue to be held in sealing engagement with the joint's walls. The system therefore continues to prevent the spread of smoke, heat and fire through the joint.

While a particular form of the invention has been illustrated and described, it will also be apparent to those skilled in the art that various modification can be made without departing from the spirit and scope of the invention. Accordingly, it is not intended that the invention be limited except by the appended claims.

What is claimed is:

1. A fire barrier system for sealing a dynamic void, comprising:

diagonally oriented support bars spanning the width of said void, each bar's ends being slideably affixed to opposite walls defining said void;

flexible fire barrier material extending across and having opposite edges extending along said void, said material being of a width substantially wider than the nominal width of said void;

means suspending from said diagonal support bars the edges of said barrier material oriented along the length of said void; and means biasing said opposite edges of said material into sealing engagement with said opposite walls.

2. The fire barrier system of claim 1 wherein said suspension means comprise individual hanger clips, pivotally affixed to said diagonal support bars and configured so as to engage said barrier material therebelow is an interhooking manner.

3. The fire barrier system of claim 2 wherein said hanger clips comprise said biasing means.

4. The fire barrier system of claim 2 wherein said biasing means comprises springs attached to said diagonal bars and wherein said springs extend across the void to engage said opposite edges of said barrier material.

5. The fire barrier of claim 1 wherein said suspension means comprise hanger rails extending along the length of said void, pivotally affixed to said support bars and configured so as to engage said barrier material therebelow in an interhooking manner.

6. The fire barrier system of claim 6 wherein said hanger rails comprise said biasing means.

7. The fire barrier of claim 6 wherein said biasing means comprises springs wherein said springs extend across the void to engage said opposite edges of said barrier material.

8. The fire barrier system of claim 1 wherein friction reducing surfaces are disposed in the interface between the barrier material and the walls of the void.

9. The fire barrier system of claim 1 wherein intumescent material is disposed in the interface between the barrier material and the walls of the void.

10. The fire barrier system of claim 1 wherein foam strips are disposed in the interface between the barrier material and the walls of the void in order to seal out cold smoke.

11. A fire barrier system sealing a dynamic void, comprising:

diagonally oriented support bars spanning the width of said void, each bar's ends being slideably affixed to opposite walls defining said void;

a cover plate disposed over said void, pivotally attached to the center of each of said support bars;

flexible fire barrier material extending across and having opposite edges extending along said void, said material being of a width substantially wider than the nominal width of said void;

means suspending from said cover plate the edges of said barrier material oriented along the length of said void; and means biasing said opposite edges of said material into sealing engagement with said opposite walls.

12. The fire barrier system of claim 11 wherein said suspension means comprise individual hanger clips affixed to said diagonal support bars and configured so as to engage said barrier material therebelow in an interhooking manner.

13. The fire barrier system of claim 12 wherein said hanger clips comprise said biasing means.

14. The fire barrier system of claim 11 wherein friction reducing surfaces are disposed in the interface between the barrier material and the walls of the void.

15. The fire barrier system of claim 11 wherein intumescent material is disposed in the interface between the barrier material and the walls of the void.

16. The fire barrier system of claim 11 wherein foam strips are disposed in the interface between the barrier material and the walls of the void in order to seal out cold smoke.

* * * * *